US009647340B2

(12) United States Patent
Yagi et al.

(10) Patent No.: US 9,647,340 B2
(45) Date of Patent: May 9, 2017

(54) THREE-AXIS ANTENNA

(71) Applicant: TOKO, INC., Tsurugashima-shi, Saitama-ken (JP)

(72) Inventors: Masayoshi Yagi, Tsurugashima (JP); Kazunari Ishii, Tsurugashima (JP)

(73) Assignee: TOKO, INC., Tsurugashima-shi, Saitama-ken (JP)

( * ) Notice: Subject to any disclaimer, the term of this patent is extended or adjusted under 35 U.S.C. 154(b) by 214 days.

(21) Appl. No.: 14/554,858

(22) Filed: Nov. 26, 2014

(65) Prior Publication Data

US 2015/0155629 A1 Jun. 4, 2015

(30) Foreign Application Priority Data

Nov. 29, 2013 (JP) ..... 2013-247171

(51) Int. Cl.

| | |
|---|---|
| ***H01Q 7/06*** | (2006.01) |
| ***H01Q 7/00*** | (2006.01) |
| ***H01Q 21/24*** | (2006.01) |
| ***H01F 5/02*** | (2006.01) |

(52) U.S. Cl.

CPC ..... *H01Q 7/06* (2013.01); *H01F 5/02* (2013.01); *H01Q 7/00* (2013.01); *H01Q 21/24* (2013.01); *H01F 2005/027* (2013.01)

(58) Field of Classification Search

CPC ..... H01Q 7/06; H01Q 7/00; H01Q 21/24
USPC ..... 343/742, 787, 788, 867
See application file for complete search history.

(56) References Cited

U.S. PATENT DOCUMENTS

| | | | | |
|---|---|---|---|---|
| 4,879,570 | A * | 11/1989 | Takizawa | H01Q 1/3291 343/713 |
| 6,924,767 | B2 * | 8/2005 | Kitahara | H01Q 7/08 343/702 |
| 7,042,411 | B2 * | 5/2006 | Yagi | H01Q 21/24 343/787 |
| 7,755,558 | B2 * | 7/2010 | Ueda | H01Q 7/08 343/728 |
| 8,451,184 | B2 * | 5/2013 | Murakami | H01Q 1/3241 343/788 |
| 2004/0061660 | A1 | 4/2004 | Yoshida et al. | |
| 2006/0152427 | A1 | 7/2006 | Ueda et al. | |
| 2013/0033408 | A1 | 2/2013 | Miki et al. | |

FOREIGN PATENT DOCUMENTS

| | | |
|---|---|---|
| JP | 2003-92509 | 3/2003 |

OTHER PUBLICATIONS

European Search Report (Application No. 14192393.8) (7 pages—dated Apr. 13, 2015).

* cited by examiner

*Primary Examiner* — Hoang Nguyen
(74) *Attorney, Agent, or Firm* — Renner, Kenner, Greive, Bobak, Taylor & Weber

(57) ABSTRACT

A three-axis antenna containing: a bobbin for housing a core, made of a resin having an top flange and a bottom flange both of which include four flange pieces at both ends of the winding column in the thickness direction of the core; a first coil and a second coil wound in the spaces between the flange pieces to cross each other at the upper and lower surfaces of the core; and a third coil wound at the side surface of the core and between the top flange and the bottom flange.

6 Claims, 3 Drawing Sheets

THREE-AXIS ANTENNA

CROSS REFERENCE TO RELATED APPLICATIONS

This application is based upon and claims the benefit of priority from the prior Japanese Patent Application No. 2013-247171, filed on Nov. 29, 2013, the entire contents of which are incorporated herein by reference.

BACKGROUND OF THE INVENTION

1. Field of the Invention

The present invention relates to a small-sized three-axis antenna which is used in a receiving system of a keyless entry system or a security system, etc.

2. Description of the Related Art

In recent years, a three-axis antenna, which is omni-directional and can be installed in a miniaturized receiving system, has been used widely as an antenna for LF band which is used in the receiving set, called as a fob, of a keyless entry system or of a security system for vehicles.

FIG. 4 is a perspective view of a conventional three-axis antenna 1. The three-axis antenna 1 includes an X axis coil 4*x*, a Y axis coil 4*y* and a Z axis coil 4*z*, the coils being orthogonally wound around a ferrite core 2 which is configured as a flat octangular body having fan-shaped auricles.

The core 2 is set on a resin base 3 to which a plurality of metal terminals are implanted, and the terminals of the X axis coil 4*x*, the Y axis coil 4*y* and the Z axis coil 4*z* are wound around winding portions 5*a* of metal terminals 5 and soldered to be electrically connected.

SUMMARY OF THE INVENTION

Problem to be Solved by the Invention

Due to general demands for miniaturization and thinning of receiving sets, a three-axis antenna is required to be smaller and thinner.

However, conventional three-axis antennas have had to put up with the problem that a smaller core provides insufficient inductance, and with the problem that a complexly shaped core requires higher processing costs and thus raises the cost of an antenna coil.

To compensate for the insufficient inductance, the apparent solution is to increase the number of windings of a coil. To fit within available space for such a winding, one option is to use a thinner core, and the other is to use thinner wire. However, since the ferrite which makes the core is brittle, the thinner the core is, the brittler it is. Thus, the manufacturing process becomes difficult and the processing costs increase. Further, use of thin wire to increase the number of winding results in the increase of the DC resistance and of the capacity between the wires. Consequently, the Q value and the self-resonant frequency dropped resulting in lower the characteristics of antenna coils. Therefore, the miniaturization of a three-axis antenna has met substantial obstacles.

Means for Solving the Problem

The three-axis antenna according to the present invention is characterized by:

a three-axis antenna comprising:

a bobbin for housing a core, said bobbin being made of a resin and having a top flange and a bottom flange both of which include four flange pieces at both ends of the winding column in the thickness direction of the core;

a first coil and a second coil wound in the spaces between the flange pieces to cross each other at the upper and lower surfaces of the core; and a third core wound at the side surface of the core and between the top flange and the bottom flange.

Effect of the Invention

According to the three-axis antenna of the present invention, even if miniaturization and space saving are carried out, it is possible to provide a three-axis antenna which is manufacturable at a low cost and has stable characteristics.

DETAILED DESCRIPTION OF THE PREFERRED EMBODIMENT

The three-axis antenna according to the present invention will be described below, referring to FIGS. 1-3.

Figure 1:
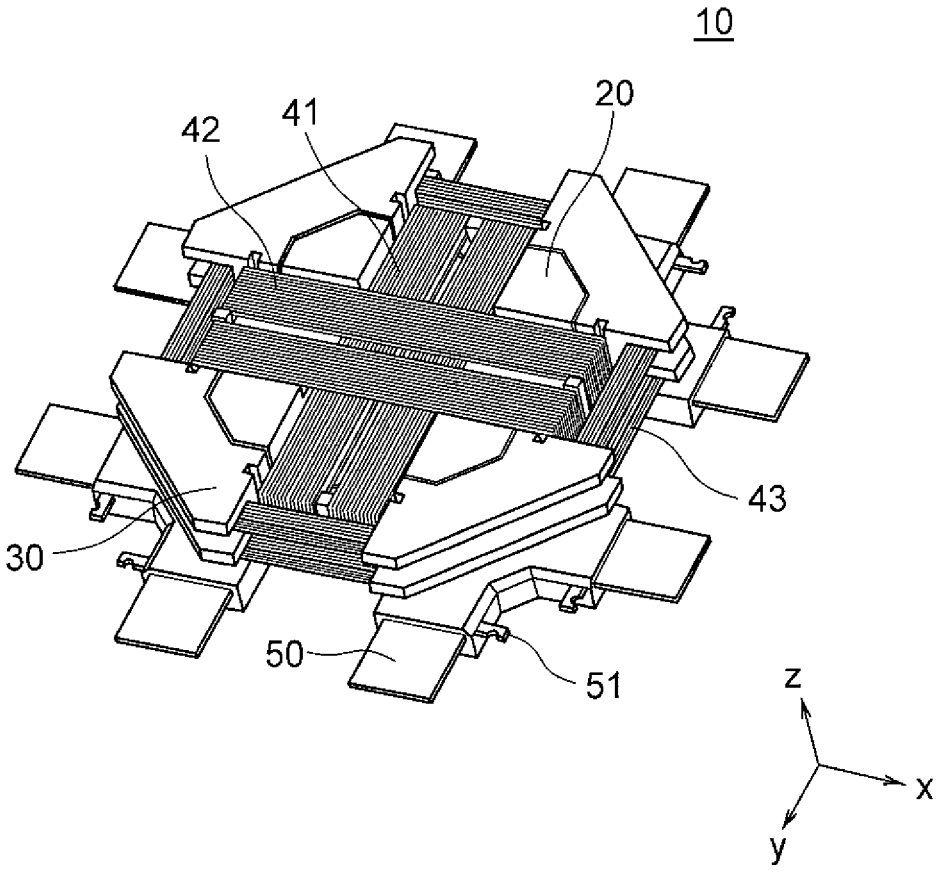
FIG. 1 is a perspective view from above of a three-axis antenna according to the present invention.

FIG. 1 is a perspective view from above of a three-axis antenna according to the present invention. FIG. 2 is an exploded perspective view thereof.

As shown in FIG. 1, a three-axis antenna 10 comprises a ferrite core 20, a resin bobbin 30, and an X axis coil 41, a Y axis coil 42 and a Z axis coil 43, on which insulation coated wires are provided respectively.

Figure 2:
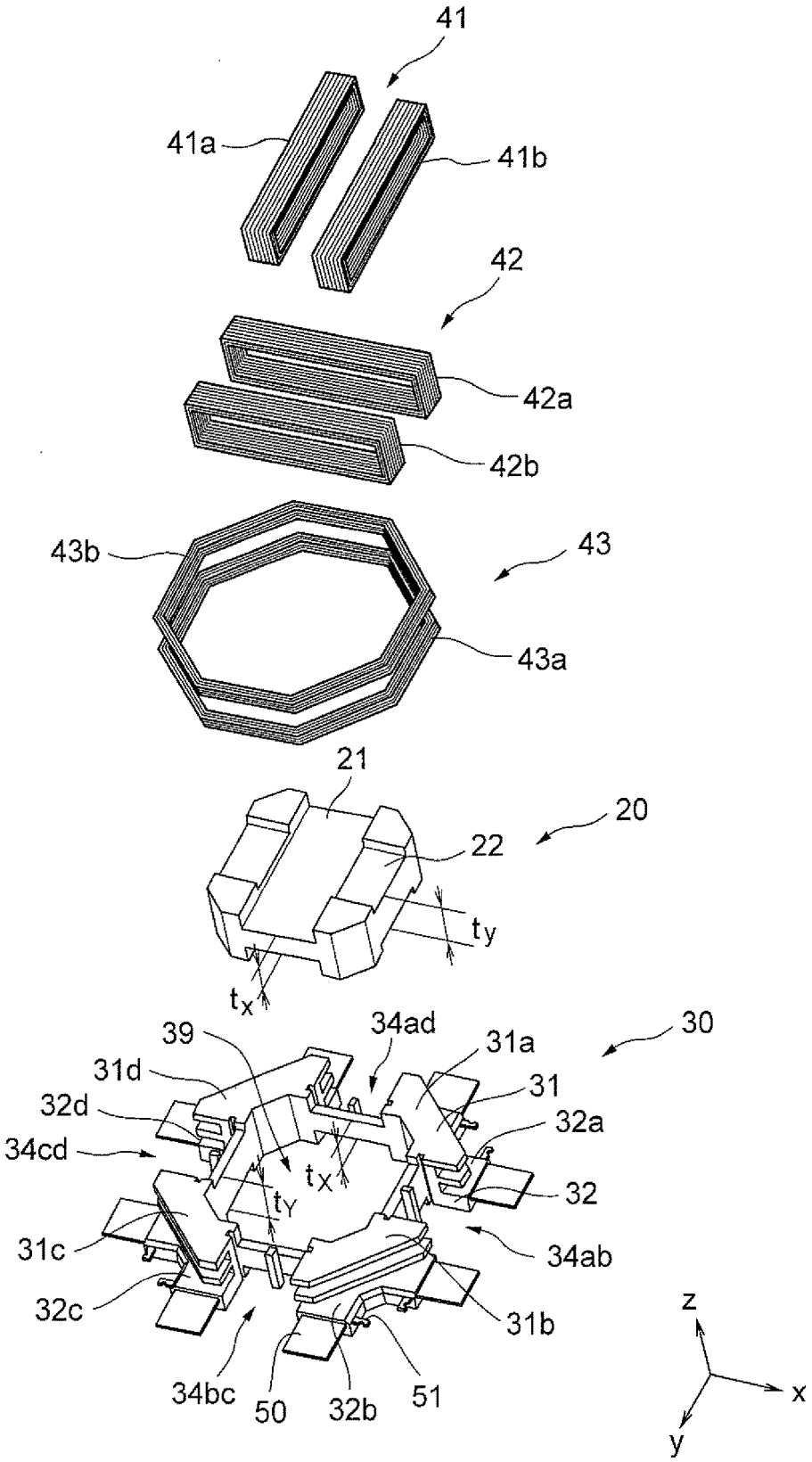
FIG. 2 is an exploded perspective view of the three-axis antenna according to the present invention.

As shown in FIG. 2, the core 20 is flat and parallelepiped-shaped, and has an X recess 21 and a Y recess 22 which cross orthogonal to each other at the corresponding positions on the top surface and bottom surface thereof. The thickness of the core 20 around the X recess 21 is tx, and the thickness of the Y recess 22 is ty, with tx<y.

A through hole 39 penetrating the core 20 in the thickness direction, a top flange 31 having four flange pieces 31*a*-31*d* on the upper end of the Z winding axis, and a bottom flange 32 having four flange pieces 32*a*-32*d* are provided on a bobbin 30.

Designating the space between the flange pieces 31*a*, 32*a* and the flange pieces 31*d*, 32*d* as a space 34*ad*, the space between the flange pieces 31*b*, 32*b* and the flange pieces 31*c*, 32*c* as a space 34*bc*, the space between the flange pieces 31*a*, 32*a* and the flange pieces 31*b*, 32*b* as a space 34*ab* and the space between the flange pieces 31*c*, 32*c* and the flange pieces 31*d*, 32*d* as a space 34*cd*, the height of the Z winding axis at the spaces 34*ad*, 34*bc* is equal to the thickness tx of the X recess 21 of the core 20, and the height of the Z winding axis at the spaces 34*ab*, 34*cd* is equal to the thickness ty of the Y recess 22 of the core 20.

The bobbin 30 houses the core 20 in the through hole 39 so that the thicknesses tx, ty of the recesses 21, 22 match the height of the Z winding axis. The X axis coil 41 and the Y axis coil 42 are wound around the core 20 orthogonally to each other at the upper surface and the lower surface, as the X axis coil 41 is wound around the space 34*ad*, 34*bc* and the recess 21 as the X winding axis, and the Y axis coil 42 is wound around the space 34*ab*, 34*cd* and the recess 22 as the Y winding axis. Further, the Z axis coil 43 is wound around the Z winding axis in the space between the top flange 31 and the bottom flange 32 to weave around and orthogonally to each of the X winding axis and the Y winding axis.

Figure 3:
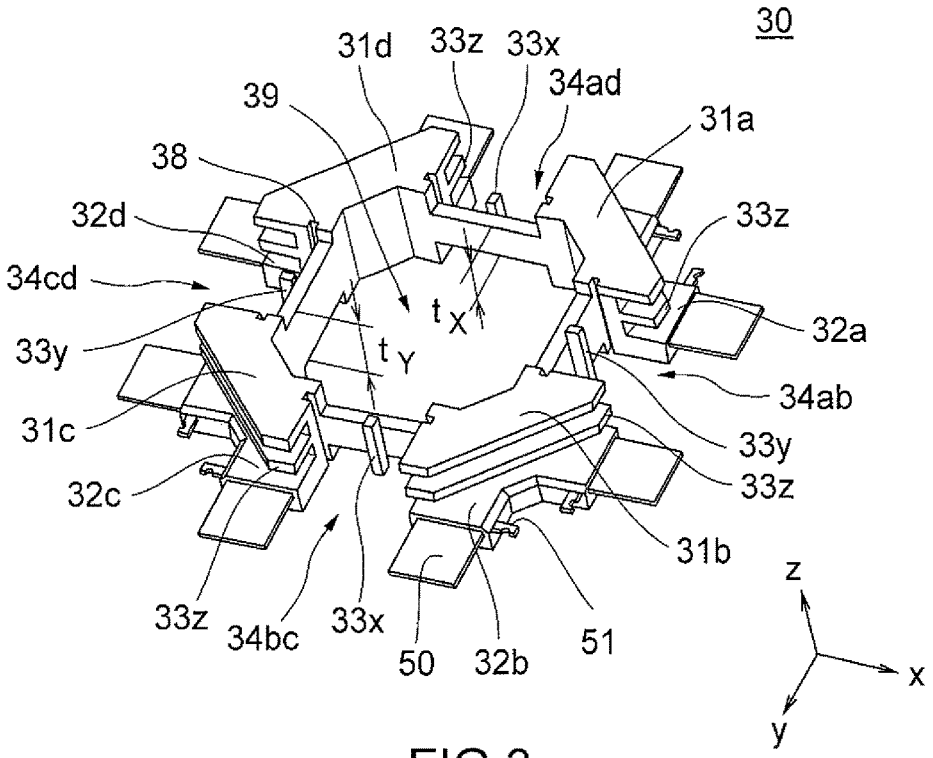
FIG. 3 is a perspective view of a bobbin of the three-axis antenna according to the present invention.
Figure 4:
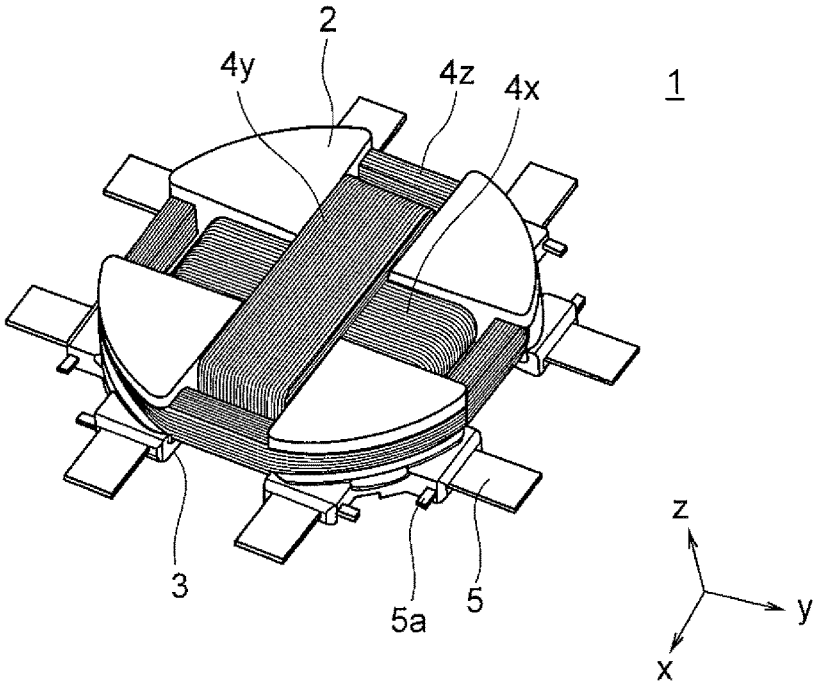
PRIOR ART FIG.4
FIG. 4 is a perspective view of a conventional three-axis antenna.

FIG. 3 is a perspective view of the bobbin 30 to show the detailed structure thereof. As shown in FIG. 3, there are intermediate flanges 33*x*, 33*y* and 33*z* around the X winding axis, the Y winding axis and the Z winding axis between the divided flanges 31, 32.

Namely, the X axis coil, the Y axis coil and the Z axis coil are divided and wound as described below:

the X axis coil 41 is divided by the intermediate flange 33*x* into the coils 41*a* and 41*b;* the Y axis coil 42 is divided by the intermediate flange 33*y* into the coils 42*a* and 42*b*; and the Z axis coil 43 is divided by the intermediate flange 33*z* into the coils 43*a* and 43*b*.

The respective coils are wound in divided manner thus the capacities between the wires are lowered. The coils can be divided into three or more by providing plural intermediate flanges.

Since the sectional height tx of the X axis coil 41 and the sectional height ty of the Y axis coil 42 are different from each other, the decline of the three-axis antenna's characteristics by the mutual contact of the X axis coil 41 and the Y axis coil 42 is avoided.

A plurality of metal terminals 50 having winding portions 51 are implanted into the bottom flange 32. The terminals of the X axis coil 41, the Y axis coil 42 and the Z axis coil 43 are wound around the respective winding portions 51 and soldered to be connected electrically.

Around the X winding axis and the Y winding axis, grooves 38 for guiding the respective terminals of the X axis coil 41 and the Y axis coil 42 are provided to prevent wires thereof from disconnection due to stress when winding.

The three-axis antenna 10 is molded in resin to expose a portion of the metal terminal 50, and the exposed portion is adaptively bent to be mounted on a printed circuit board (not shown).

Without the auricular portions of the conventional three-axis antenna, simplified structure of the three-axis antenna 10 means that the main processing costs are low. As the bobbin is made of tough resin, it is easily possible to decrease the thickness of the bobbin so as to secure a space for winding.

As a result, a three-axis antenna of low manufacturing cost, and a miniaturized and space saving profile will be provided. The three coils 41, 42 and 43 are wound in divided manner respectively so that the capacities between the wires of the coils can be decreased to provide a three-axis antenna of consistent characteristics.

Although conventional antennas can be modified to divide the coils into more than two by providing protrusions on a core, it will result in brittle structure due to the complicated shape and in high costs of processing.

The present invention is preferable to conventional antennas since the flanges on a bobbin of resin are sturdy. Although in the abovementioned embodiment the cores are shown as parallelepipeds, a flat cylindrical shape is also employable. Also, a mixture of magnetic powder and the resin material can be used as the resin for the bobbins.

EXPLANATIONS OF CODES

1, 10 three-axis antenna
2, 20 core
21 X recess
22 Y recess
3 base
30 bobbin
31 top flange
32 bottom flange
31*a*, 31*b*, 31*c*, 31*d*, 32*a*, 32*b*, 32*c*, 32*d* flange piece
33*x*, 33*y*, 33*z* intermediate flange
34*ab*, 34*bc*, 34*cd*, 34*ad* space
38 groove
39 through hole
4*x*, 41 X axis coil
4*y*, 42 Y axis coil
4*z*, 43 Z axis coil
5, 50 metal terminal
5*a*, 51 winding portion
tx, ty thickness of core (sectional height of coil)

What is claimed is:

1. A three-axis antenna comprising:

a bobbin for housing a core, said bobbin being made of a resin and having a top flange and a bottom flange both of which include four flange pieces at both ends of the winding column in the thickness direction of the core and said bobbin further having an intermediate flange formed between the top and the bottom flanges;

a first coil and a second coil wound in a space between the flange pieces to cross each other at the upper and lower surfaces of the core; and a third coil wound at the periphery of the core and between the top flange and the bottom flange, the third coil being divided by the intermediate flange.

2. A three-axis antenna of claim 1, wherein:

the intermediate flange is formed in the space between the flange pieces; and one of the first and the second coils is divided by the intermediate flange.

3. A three-axis antenna of claim 2, wherein the sectional height of the winding column of the first coil and the sectional height of the winding column of the second coil are different from each other.

4. A three-axis antenna of claim 3, wherein a metal terminal having a winding portion is implanted into the bottom flange.

5. A three-axis antenna of claim 4, wherein a groove for passing the terminal of the coil is provided in the space.

6. A three-axis antenna of claim 1, wherein the bobbin is made of a mixture of a magnetic material and a resin.

* * * * *